US006708662B2

(12) United States Patent
Miyashita et al.

(10) Patent No.: US 6,708,662 B2
(45) Date of Patent: Mar. 23, 2004

(54) INTAKE SYSTEM OF OUTBOARD MOTOR

(75) Inventors: Yasushi Miyashita, Hamamatsu (JP); Jiro Saiga, Hamamatsu (JP); Katsuhiro Fukuda, Hamamatsu (JP)

(73) Assignee: Suzuki Kabushiki Kaisha, Hamamatsu (JP)

( * ) Notice: Subject to any disclaimer, the term of this patent is extended or adjusted under 35 U.S.C. 154(b) by 5 days.

(21) Appl. No.: 10/137,452

(22) Filed: May 3, 2002

(65) Prior Publication Data

US 2002/0170519 A1 Nov. 21, 2002

(30) Foreign Application Priority Data

May 18, 2001 (JP) ..... P.2001-149901

(51) Int. Cl.[7] ..... F02B 75/22
(52) U.S. Cl. ..... 123/184.36; 123/184.55
(58) Field of Search ..... 123/184.36, 184.21, 123/184.34, 184.55

(56) References Cited

U.S. PATENT DOCUMENTS 5,048,471 A * 9/1991 Takii et al. ..... 123/184.36
5,092,285 A * 3/1992 Beaber ..... 123/184.34
5,590,628 A * 1/1997 Patyi et al. ..... 123/184.36
5,632,239 A * 5/1997 Patyi et al. ..... 123/184.36
6,260,528 B1 * 7/2001 Pringle et al. ..... 123/184.55
6,298,815 B1 * 10/2001 Kashima et al. ..... 123/184.21
6,408,809 B2 * 6/2002 Suzuki ..... 123/184.36

FOREIGN PATENT DOCUMENTS

JP 7-102979 4/1995

* cited by examiner

*Primary Examiner*—Henry C. Yuen
*Assistant Examiner*—Jason Benton
(74) *Attorney, Agent, or Firm*—Oblon, Spivak, McClelland, Maier & Neustadt, P.C.

(57) ABSTRACT

An intake system of an outboard motor including a vertically arranged V-type engine comprises, an intake manifold connected to the intake ports, a surge tank connected to the intake manifold and disposed at a rear side from a central portion of the engine, a throttle body provided with a throttle valve, a plurality of intake passages for high revolution operation of the engine. The intake passages for high revolution operation extend from the surge tank and are communicated with the intake manifold, and the intake passages for low/intermediate revolution operation extend from the surge tank and are joined with the intake passages for high revolution operation, respectively. Each of the intake passages for low/intermediate revolution operation has a length longer than that for high revolution operation. A valve open/close mechanism is also disposed for opening/closing all at once portions upstream side of the joined portions of both the intake passages of the engine.

9 Claims, 5 Drawing Sheets

INTAKE SYSTEM OF OUTBOARD MOTOR

BACKGROUND OF THE INVENTION

The present invention relates to an intake system or device of an outboard motor mounted with a V-type engine unit.

There is known a technology concerning an intake system of a four-stroke-cycle reciprocal engine in which length of an intake passage connecting a surge tank and an intake port is constructed to be variable into two stages to thereby enhance an intake air filling efficiency along a wide revolution area of the engine, as disclosed, for example, in Japanese Patent Laid-open Publication No. HEI 7-102979. In this known publication, there are arranged, above the V-type engine, an intake passage for high revolution (speed) area and an intake passage for intermediate and low revolution area along a lower surface of a surge tank having a flat shape expanding in the width direction of the engine, and the intake passage for the intermediate and low revolution area has substantially a linear shape extending in the width direction of the V-type engine.

However, according to the arrangement of the known art mentioned above, since the surge tank has a flat shape expanding in the engine width direction above the engine, the surge tank occupies a large space above the V-type engine. Furthermore, in a case where such layout is applied to an outboard motor mounted with a vertical type engine, the surge tank is located on the rear side of the engine and an engine cover having a large size or dimension is therefore required, which results in enlargement of the rear portion of the outboard motor body in the width direction thereof.

A boat or like equipped with the outboard motor changes its advancing direction by rotating (pivoting) the outboard motor with respect to a hull (stern) of the boat, and accordingly, it is not desirable to widen the width of the rear portion of the outboard motor for the reason that the rotating angle, i.e. steering angle, of the outboard motor is reduced. Moreover, In a case of an arrangement of two outboard motors at the rear portion of the hull, there is a fear of interference of these outboard motors from each other at the time of steering operation of large angles.

In order to reduce the width of the rear portion of the outboard motor, it may be considered to reduce an inner volume of the surge tank. However, such countermeasure is not desirable in terms of intake performance.

Furthermore, the above prior art provides a structure in which an intake passage for a low/intermediate revolution operation of the engine is formed linearly so as to provide a short length of about ½ (half) of the width of a surge tank, which provided inconvenience in the intake filling coefficiency at the low/intermediate revolution area of the engine.

Still furthermore, because of the structure in which the surge tank has a flat shape and a wall portion thereof is disposed in the vicinity of an inlet of the intake passage for high revolution operation, there also provided inconvenience in the intake filling coefficiency at the high revolution area of the engine.

SUMMARY OF THE INVENTION

An object of the present invention is to substantially eliminate defects or inconveniences encountered in the prior art mentioned above and to provide an intake system of an outboard motor having a structure capable of improving an engine performance around substantially all the engine revolution operation area, making compact an entire structure of the outboard motor, ensuring a large steering angle of a hull and easily manufacturing the outboard motor at a reduced cost.

This and other objects can be achieved according to the present invention by providing an intake system of an outboard motor, which includes a vertically arranged V-type engine having a crankshaft extending perpendicularly therein and right and left cylinder banks opened in V-shape towards a rear side as viewed in a plan view, and in which intake ports of respective cylinders are opened to the inside of the V-shape arrangement, the intake system comprising:

an intake manifold connected to the intake ports;

a surge tank connected to the intake manifold and disposed at a rear side from a central portion of the engine;

a throttle body mounted to the surge tank and provided with a throttle valve;

a plurality of intake passages for high revolution operation of the engine, the intake passages for high revolution operation extending from the surge tank and being communicated with the intake manifold, the plural intake passages for high revolution operation having a number corresponding to a number of the cylinders of the engine;

a plurality of intake passages for low/intermediate revolution operation of the engine, the intake passages for low/intermediate revolution operation extending from the surge tank and being joined with the intake passages for high revolution operation, respectively, the plural intake passages for low/intermediate revolution operation having a number corresponding to a number of the cylinders of the engine and each of the intake passages for low/intermediate revolution operation having a length longer than that for high revolution operation; and a valve open/close mechanism disposed for opening/closing all at once portions upstream side of the joined portions of the intake passages for low/intermediate revolution operation and those for high revolution operation, the intake passages for low/intermediate revolution operation extending, as viewed in a plan view, from both side surfaces of the surge tank towards both outsides in a width direction of an outboard motor body so as to be positioned at a rear portion of both the cylinder banks of the V-type engine, so that the surge tank and the intake passages for low/intermediate revolution operation provides a protrusion protruding towards a rear side of the engine.

According to the structure of the intake system of the outboard motor of the present invention, the air in the surge tank flows towards the intake ports, when the valve open/close mechanism is closed, through the intake passages for low/intermediate revolution operation of the engine each having a long length in comparison with that of the intake passage for high revolution operation, and on the contrary, flows towards the intake ports, when the valve open/close mechanism is opened, through the the intake passages for high revolution operation of the engine each having a short length in comparison with that of the intake passage for low/intermediate revolution operation. Accordingly, by controlling the valve open/close mechanism so as to be closed at the time of the engine low revolution operation and, on the contrary, to be opened at the time of the engine high revolution operation, the intake passages suitable for the respective engine revolution areas are obtainable, and moreover, the intake filling efficiency can be ensured at the wide engine revolution operation area, thus improving the engine performance.

Furthermore, the surge tank and the intake passages for low/intermediate revolution operation are formed to have a protrusion protruding towards a rear side of the engine. According to this structure, the expansion of the surge tank in the width direction of the outboard motor body can be prevented without reducing the volume of the surge tank, so that the outboard motor body can be made compact, and the large steering angle of the hull can be also ensured.

In preferred embodiment of the above aspect of the present invention, the plural intake passages for low/intermediate revolution operation includes a half for left-side cylinder bank of the V-type engine to a right side of the surge tank and another half for right-side cylinder bank of the V-type engine to a left side of the surge tank so that axial directions of the intake passages for low/intermediate revolution operation at the joining portions thereof to the intake passages for high revolution operation substantially accord with axial directions of the passages of the intake manifold.

Each of the intake passages for low/intermediate revolution operation once extends towards both outside directions from a width direction of the outboard motor body, is turned in U-shape in a vertical direction and then extends again towards an inside in the width direction of the outboard motor body to thereby join the intake passages for low/intermediate revolution operation to the intake passages for high revolution operation.

The intake passages for high revolution operation of the engine is provided with surge thank side inlets arranged in a vertical single line in parallel to the crankshaft of the engine, the valve open/close mechanism includes a plurality of butterfly valves disposed at the surge tank side inlets, and the butterfly valves are provided with a single valve rotating shaft having an axis substantially in parallel to the crankshaft of the engine.

The valve open/close mechanism includes a plurality of butterfly valves disposed at surge tank side inlets of the intake passages for high revolution operation, an actuator, as driving means, mounted to a lower end of the valve rotating shaft extending from the lower surface of the surge tank, and an expansion rod extending from the actuator to be connected to the crankshaft connected to the valve rotating shaft. Moreover, the throttle valve is provided for vertical one end of the surge tank and the valve open/close mechanism includes a drive member provided for another one end of the surge tank.

The V-type engine is a water-cooled 6-cylinder V-type engine, three in each side of V-arrangement.

The surge tank is provided with a lid member.

The surge tank, the intake passages for high revolution operation of an engine and the intake passages for low/intermediate revolution operation of the engine are divided into front and rear halves from a division surface along an extending direction of the intake passages for low/intermediate revolution operation.

According to such preferred embodiment, in the case where the intake passage for low/intermediate revolution operation of the engine becomes long, the passage from the intake passage for low/intermediate revolution operation to the portion connected to the intake manifold becomes substantially linear, thus reducing the intake resistance, and hence, the engine operation performance in the low/intermediate revolution area of the engine can be improved.

Still furthermore, the butterfly valves of the valve open/close mechanism can be driven by a single valve rotating shaft disposed in parallel to the engine crankshaft. Therefore, the structure of the intake system can be made compact and easily manufactured, thus improving maneuverability and reliability in performance and reducing occurrence of defect.

Still furthermore, the improved arrangement of the surge tank makes possible to effectively use the inner space of the engine cover and the inner volume of the surge tank can be made large.

The natures and further characteristic features of the present invention can be mode more clear from the following descriptions made with reference to the accompanying drawings.

DESCRIPTION OF THE PREFERRED EMBODIMENT

Figure 1:
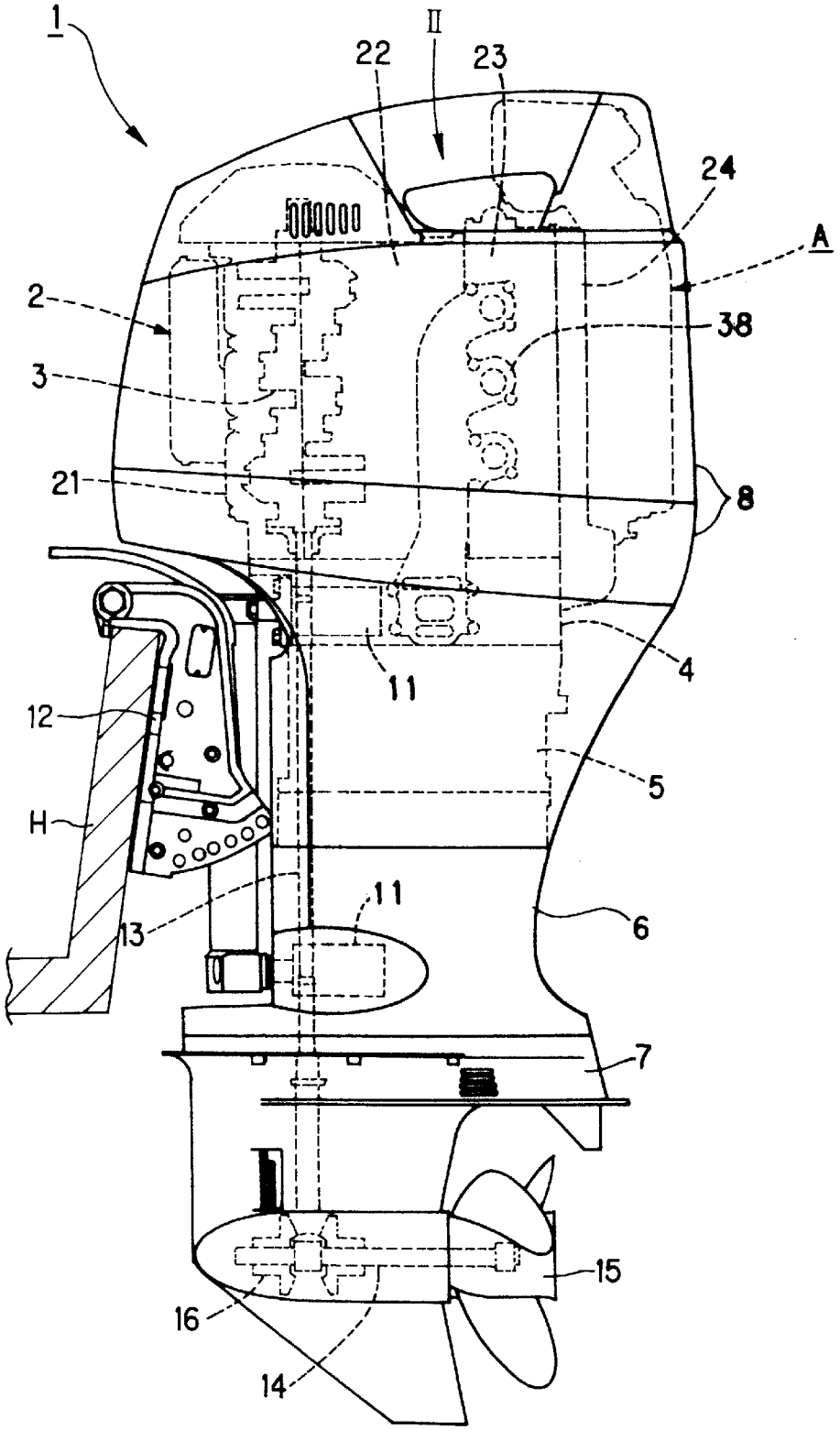
FIG. 1 is a left-hand side view showing one example of an outboard motor to which an intake system of the present invention is applied.

A preferred embodiment according to the intake system of the present invention will be described hereunder first with reference to FIGS. 1 and 2, in which a left side is a front side (hull (H) side) and a right side is a rear side of a boat or like (FIG. 1).

Further, it is first to be noted that terms such as "upper", "lower", "right", "left" and the like are used herein with reference to an illustrated state in figures or an engine installed state, and a hull side of an outboard motor is referred to as front side thereof.

Figure 2:
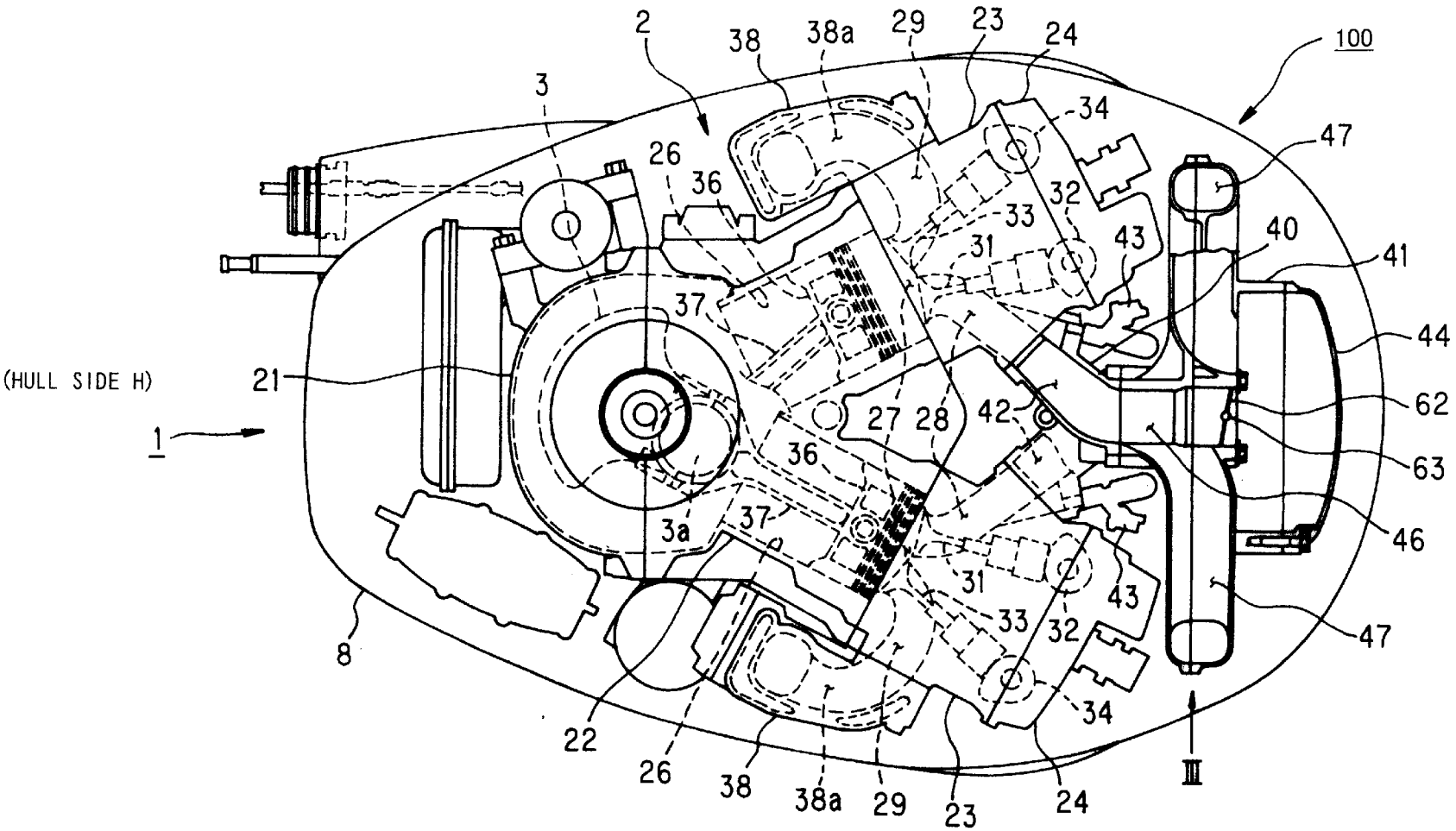
FIG. 2 is a plan view showing a V-type engine of one example according to the present invention as viewed from an arrow II in FIG. 1.

With reference to FIGS. 1 and 2, an outboard motor 1 is provided with a V-type engine 2, for example, water-cooled 4 stroke-cycle V-type 6-cylinder engine, in which a crankshaft 3 is arranged perpendicularly and mounted and fixed vertically o an upper surface of an engine holder 4 having a flat plate. The engine holder 4 has a lower surface to which an oil pan 5 is mounted and joined. A drive housing 6 and a gear housing 7 are secured in this order to the lower portion of the oil pan 5, and the V-type engine 2, the engine holder 4 and a portion of the oil pan 5 are covered by an engine cover 8 which is dividable into upper and lower two sections.

A pair of engine mount (mount members) 11 are arranged to portions in the vicinity of front edge portions of the engine holder 4 and the drive housing 6, respectively. Front end portions of these engine mounts 11 are operatively connected to a clamp bracket 12, which is then mounted to a transom, not shown, of a hull side H of the boat or like as shown in FIG. 2.

A drive shaft 13 is coupled to an lower end portion of the crankshaft 3 perpendicularly disposed in the V-type engine 2 to be integrally rotatable and penetrates into the drive housing and extends to the inside of the gear housing 7. In the gear housing 7, a propeller shaft 15 extending in a for-and-aft direction of the outboard motor is supported, and a propeller 15 is integrally secured to the rear side end portion of the propeller shaft 14. A bevel gear mechanism 16 is arranged at a crossing point of the drive shaft 13 and the propeller shaft 14 so as to transmit the rotation of the drive shaft 13 to the propeller shaft 14, thus driving and rotating the propeller 15.

The V-type engine 2 comprises, in an assembly, a crank case 21, a cylinder block 22, a cylinder head 23, and a head cover 24 in this order from the front side (hull side, i.e., left side as viewed in FIG. 1). A crankshaft 3 is located and supported at a mating (joining) surface of the crank case 21 and the cylinder block 23, and a pair of cylinder heads 23 and a pair of head covers 24 are arranged at left and right side portions so as to constitute V-shaped cylinder banks opened, respectively, towards the rear side in a plane view.

With reference to FIG. 2, in the cylinder block 22, there is formed with cylinder bores 26 each in which three cylinders are arranged, and on the side of the cylinder head 23, there are also arranged a combustion chamber 27 aligning with each of the cylinder bores 26, and an intake port 28 and an exhaust port 29 which are communicated with the combustion chamber 27.

The intake port 28 has an entrance which is opened inside each of the V-shaped cylinder bank (cylinder head 23), and the communication passage with the combustion chamber 27 is controlled to be opened or closed by the operation of an intake valve 31 and an intake camshaft 32. Furthermore, the exhaust port 29 has an entrance which is opened to the outside of each of the V-shaped cylinder banks, and the communication passage communicated with the combustion chamber 27 is controlled to be opened or closed by an exhaust valve 33 and an exhaust camshaft 34.

In the respective cylinder bores 26, pistons 36 are fitted to be slidable through a connection rod 37, and each of the pistons 36 is coupled to a crank pin 3*a* eccentrically provided for the crankshaft 3 through the connection rod 37. According to such arrangement, the reciprocal motion of the respective cylinders 36 in the cylinder bores 26 is converted into a rotational motion of the crankshaft 3, which is then transmitted to the drive shaft 13 as output of the V-type engine 2.

Exhaust manifolds 38 are connected to the exhaust ports of the respective cylinder heads 23, and lower end portions thereof are connected to lateral (right and left) side surfaces of the engine holder 4. In each of the exhaust manifolds 38, there is defined an exhaust collection passage 38*a* (see FIG. 2) for collecting the exhaust gas exhausted from the exhaust ports 29 of the three cylinders on each side, and the exhaust gas passing therethrough is exhausted into water through an exhaust passage, not shown, formed inside the engine holder 4, the oil pan 5 and the drive housing 6.

Next, with reference to FIGS. 2 to 5, a surge tank 41 is arranged on the rear side of the central portion of the V-type engine 2 through an intake manifold 40. The intake manifold 40 is formed of, for example, aluminium alloy material and provided with a plurality of manifold passages 42 corresponding to the number of the cylinders (6 passages in this embodiment). These 6 manifold passages 42 are communicated alternately with the intake ports 28 of the lateral cylinder banks (cylinder heads 23) in order from the upper side in the illustration of FIG. 2, and fuel injectors 43 are mounted to the intake ports 28, respectively. The respective fuel injectors 43 inject fuel towards the deep portions of the intake ports 28.

Furthermore, the surge tank 41 is a product formed of a synthetic resin material, for example, and formed so as to provide a single vertically elongated shape, and the back side surface (rear side, i.e., upper side in FIG. 2) of the surge tank 41 is covered by a lid member 44 to be detachable. Furthermore, with reference to FIG. 3, for example, the surge tank 41 is also formed, at its uppermost end portion, with a throttle body connection port 45 and integrally formed with a plurality of intake passages 46 for high revolution operation and a plurality of intake passages 47 for low/intermediate revolution operation, corresponding to the numbers of the cylinders of the V-type engine 2 (i.e., 6 cylinders in this embodiment) so as to extend outward.

Figure 3:
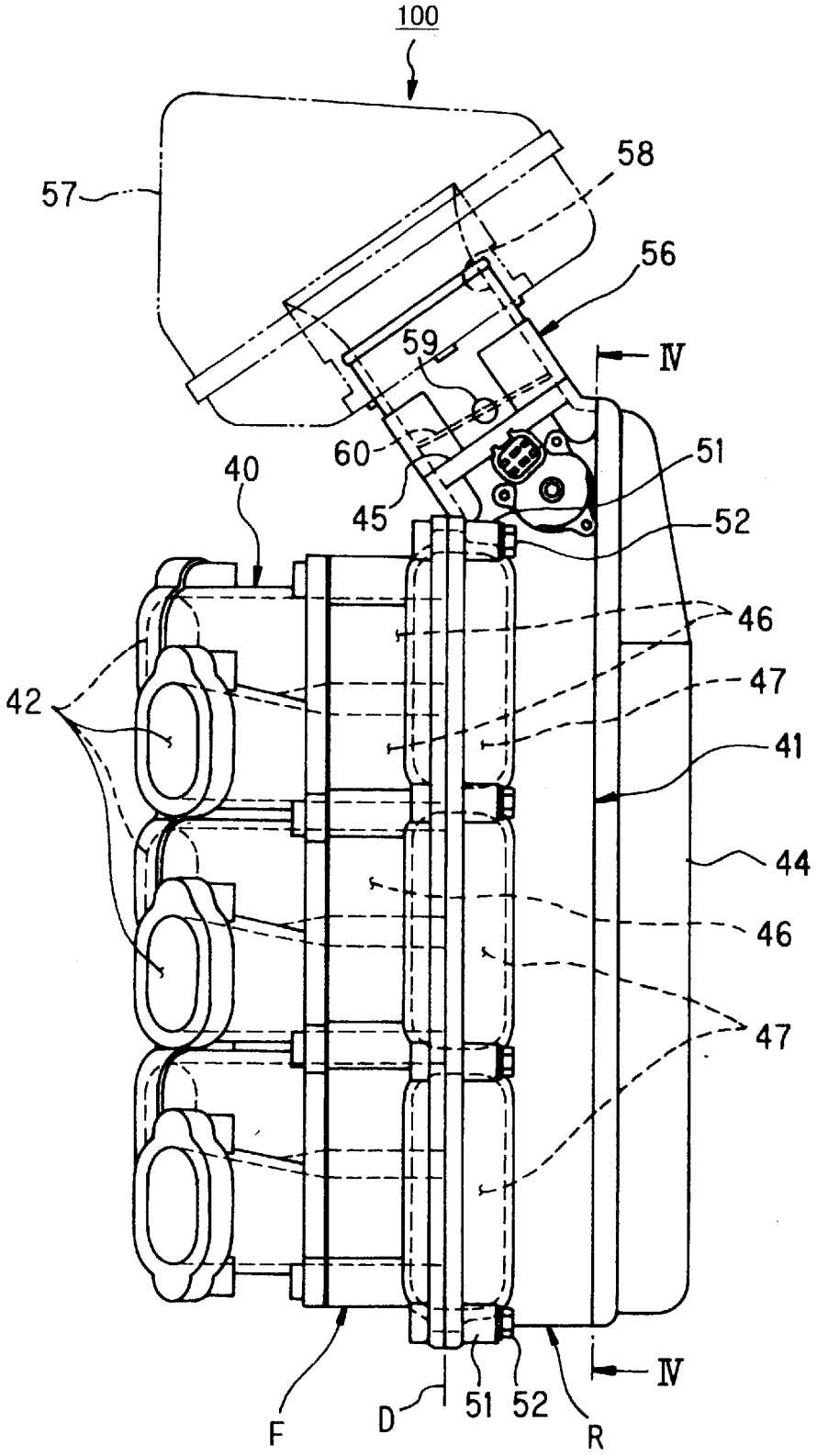
FIG. 3 is a left-hand side view of the intake device viewed from an arrow III in FIG. 2.
Figure 4:
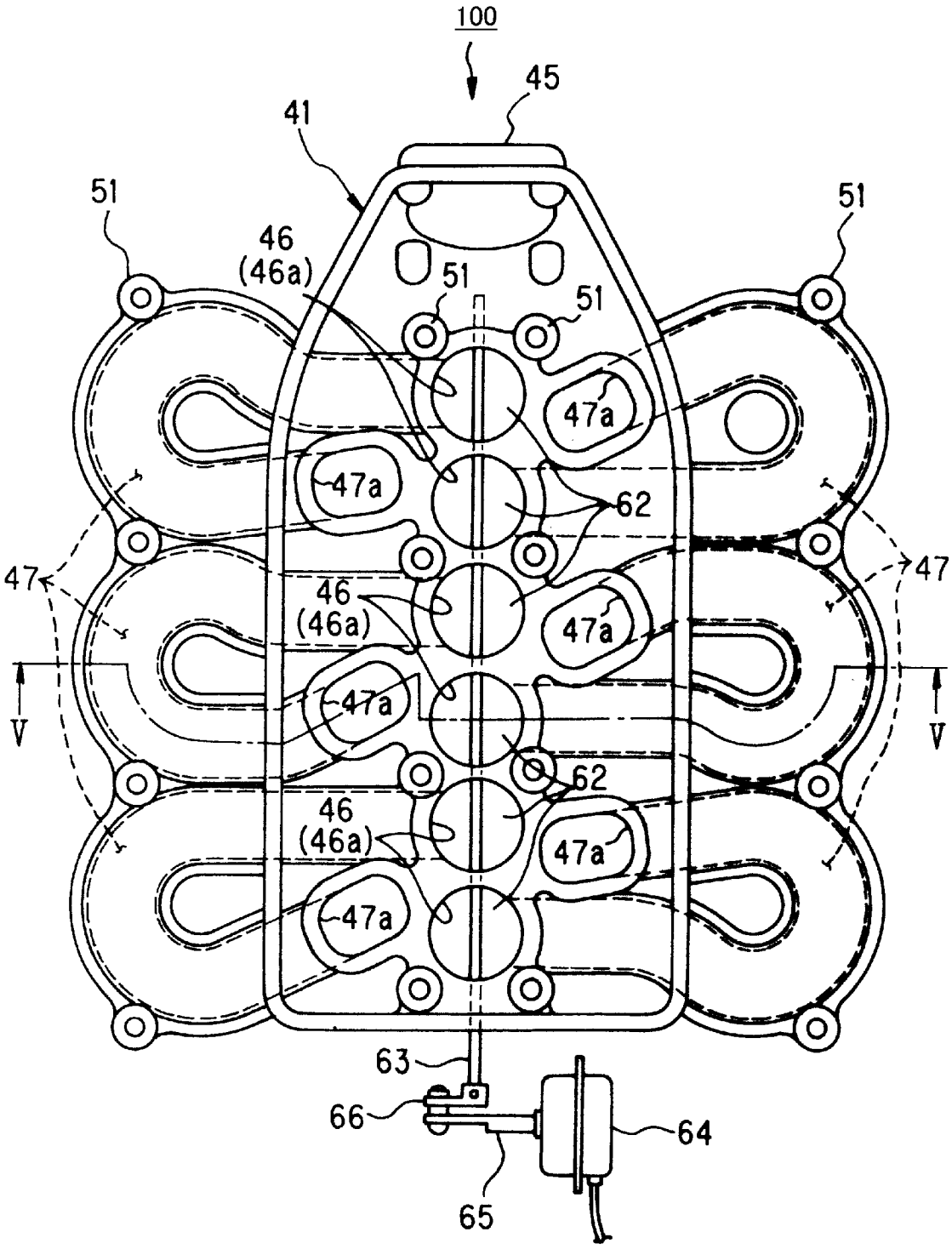
FIG. 4 is a rear side view of an intake device viewed along a line VI—VI in FIG. 3.
Figure 5:
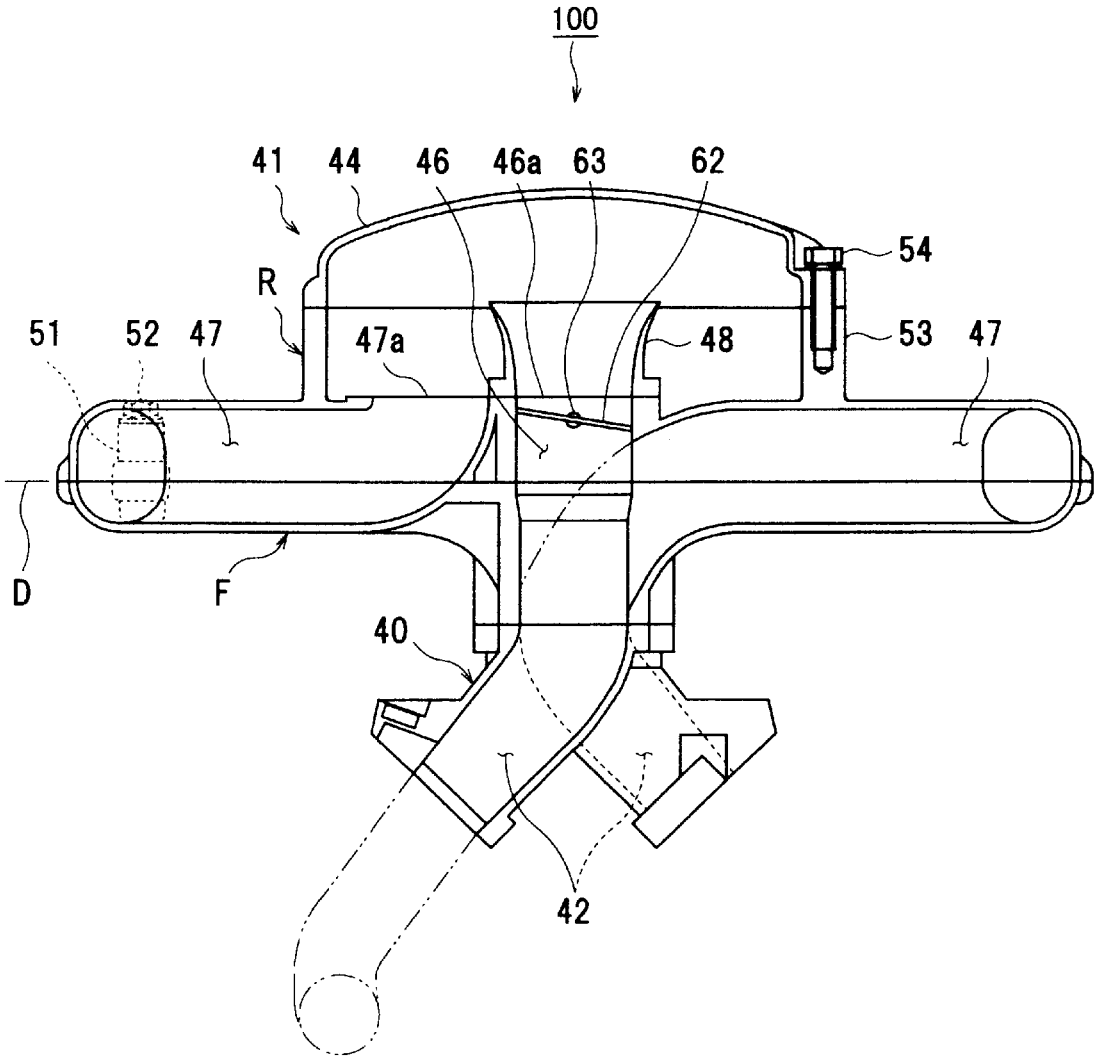
FIG. 5 is a sectional view taking along the line V—V in FIG. 4.

Referring to FIGS. 3 to 5, the 6 intake passages 46 for high revolution operation extend sharply linearly forward from the front surface, i.e., a surface on the side of the V-type engine 2, and are connected directly to the manifold passages 42 of the intake manifold 40, respectively. In the illustrated embodiment, 6 surge tank side inlets 46*a* (FIG. 4) of the respective intake manifold passages 46 for high revolution operation are arranged in vertical one (single) line so as to be parallel to the crankshaft 3 of the engine 2 and funnels 48 for intake rectification are provided for the respective inlets 46*a* (FIG. 5).

On the other hand, the 6 intake passages 47 for low/intermediate revolution operation are provided with surge tank side inlets 47*a*, respectively, which are opened in the vicinity of the surge tank side inlet 46*a* of the intake passages 46 for high revolution operation for the corresponding cylinders. The intake passages 47 then extend outward in both width sides of the machine body of the outboard motor, then are turned in U-shape in the vertical direction and again extend inside in the width direction of the outboard motor and, finally, are joined with the intake passages 46*a*. Accordingly, the length of each of the intake passages 47 of low/intermediate revolution operation is made considerably longer than that of the intake passage 46 for high revolution operation.

The intake passages 47 for low/intermediate revolution operation for the left side cylinder bank of the V-type engine 2 are arranged on the right side of the surge tank 41, and on the other hand, the other intake passages 47 for low/intermediate revolution operation for the right side cylinder bank of the V-type engine 2 are arranged on the left side of the surge tank 41. That is, the intake passages 47 for low/intermediate revolution operation for the left side cylinder bank once extend towards the right side of the surge tank 41 and are then turned in U-shape around the downward direction and joined to the intake passages 46 for high revolution operation communicated with the left-side cylinder bank, and on the other hand, the other intake passages 47 for low/intermediate revolution operation for the right side cylinder bank once extend towards the left side of the surge tank 41 and are then turned in U-shape around the upward direction and joined to the intake passages 46 for high revolution operation communicated with the right-side cylinder bank.

With reference to FIG. 5, at the joining portion of the intake passages 47 for low/intermediate revolution operation to the intake passages 46 for high revolution operation, the intake passages 47 for low/intermediate revolution operation are obliquely joined so as to be directed towards portions near the most downward portion of the intake passages 46 for high revolution operation (that is, near the inlet of the manifold passage 42) so that the axial direction of the intake passage 47 for low/intermediate revolution operation accords with the axial direction of the manifold passage 42 of the intake manifold 40.

As mentioned above, as can be seen from FIG. 2, the respective intake passages 47 for low/intermediate revolution operation of the engine are disposed so as to extend, as viewed in a plan view, towards both outside directions in the width direction of the outboard motor body from both the side surfaces of the surge tank 41 and positioned on the rear side of both the cylinder banks of the V-type engine 2. In this arrangement, the surge tank 41 and the intake passages 47 constitute a protruded structure directed to the rear side of the V-type engine 2.

Further, as shown in FIGS. 3 and 5, the surge tank 41, the intake passages 46 for high revolution operation and the intake passages 47 for low/intermediate revolution operation constitute a structure dividable into front-side body F and rear-side body R which are divided along a division surface D along the extending direction of the intake passages 47 for low/intermediate revolution operation. This divided structure can be assembled into an integral body by means of fastening bosses 51 and vises 52 at 16 portions in this embodiment. According to such structure, the divided bodies F and R can be easily formed from a resin material through, for example, a molding process. Furthermore, the lid member 44 of the surge tank 41 is fastened, by means of vis 54, to a fastening boss 53 formed on the side of the divided body R as shown in FIG. 5.

Incidentally, a throttle body 56 as a separate member is connected to the throttle body connection port 45 formed to the uppermost portion of the surge tank 41, and an air cleaner 57 is disposed at a portion further above the throttle body 56 as shown in FIG. 3. The throttle body 56 is composed of a cylindrical throttle passage body 58 and a butterfly-type throttle valve 60, which is disposed inside the throttle passage body 58 and is opened or closed by a valve rotating shaft 59. In an operation of a throttle device, not shown, by a rider on a boat or like, the throttle valve 60 is rotated about the valve rotating shaft 59 to thereby change the passage area of the throttle passage body 58. When the throttle valve 60 is being widely opened, the passage area of the throttle passage body 58 is widened and air amount supplied into the surge tank 41 (that is, air-fuel mixture amount supplied to the engine 2) can be increased and the engine output can be hence increased.

Furthermore, the respective surge tank side inlets 46*a* of the 6 intake passages 46 for high revolution operation are arranged in substantially a vertical line as mentioned hereinbefore, and butterfly valves 62 for a valve open/close mechanism are disposed respectively to the surge tank side inlets 46*a*. These butterfly valves 62 are all integrally driven by the rotational motion of the single valve rotating shaft 63 disposed in parallel to the crankshaft 3 extending perpendicularly in the engine 3. Accordingly, all the butterfly valves 62 are rotated at once by the rotation of the valve rotating shaft 63, so that the portions of the intake passages 46 for high revolution operation upstream side of joining portions to the intake passages 47 for low/intermediate revolution operation are opened or closed all at once.

With reference to FIG. 4, the valve rotating shaft 63 has a lower end portion which projects downward, as viewed, from the lower surface of the surge tank 41 and to which an actuator 64 as driving means is secured. That is, the throttle body 56 is arranged to the upper end portion of the surge tank 41 and, on the other hand, the actuator 64 is disposed to the lower end portion thereof.

An expansion (expansion/contraction) rod 65 extends horizontally from the actuator 64, and the front end of the expansion rod 65 is coupled to a crank 66 disposed to the lower end portion of the valve rotating shaft 63, whereby when the rod 65 is expanded or contracted, the crank 66 and the valve rotating shaft 63 are rotated to thereby open or close the butterfly valve 62.

There may be used, as such actuator 64, an electric one utilizing such as solenoid or servo-motor, pressure-type (pressurizing) utilizing such as pneumatic cylinder or exhaust-pressure cylinder, or mechanic one utilizing such as governor. Further, a structure that the valve rotating shaft 63 is directly rotated by the actuator 64 may be also utilized.

As mentioned above, the intake device 100 according to the present invention comprises the intake manifold 40, the surge tank 41 provided with the lid member 44, the intake passages 46 for high revolution operation of the V-type engine 2, the intake passages 47 for low/intermediate revolution operation of the V-type engine 2, the throttle body 56, and the valve open/close mechanism including the butterfly valve 62, the valve rotating shaft 63, the actuator 64, the expansion (expansion/contraction) rod 65 and the crank 66.

During the operation of the V-type engine 2, the air sucked into the surge tank 41 through the air cleaner 57 and the throttle body 56 passes through the intake passages 47 for low/intermediate revolution operation each having the long length in the case that the butterfly valve 62 is closed, and on the contrary, in the case that the butterfly valve 62 is opened, this sucked air passes through intake passages 46 for high revolution operation each having a short length. In each case, the fuel is mixed with the air by the fuel injector 43 at the time of passing through the intake manifold 40, i.e., manifold passage 42, and the air-fuel mixture is then supplied to each of the intake ports 28 of the engine 2.

The actuator 64 is controlled so as to close the butterfly valve 62 at the engine low/intermediate revolution area, and to open the butterfly valve 62 when the engine revolution (driving speed) reaches a high revolution area exceeding a predetermined revolution number (for example, 4000 r.p.m.).

At the engine low/intermediate revolution area of the engine 2, each of the intake passages 47 for low/intermediate revolution operation through which the air in the surge tank passes has a long passage length, so that an intake inertia function occurs in the intake passages 47 in accordance with intake pulsation and an intake filling efficiency is enhanced, thus improving the engine operational performance such as torque characteristic at the engine low/intermediate revolution area.

On the other hand, at the engine high revolution area, since each of the intake passages 46 for high revolution operation through which the air in the surge tank 41 passes has a short passage length, air passing resistance becomes small and the air flow velocity is therefore increased, so that the intake filling efficiency is enhanced, thus improving the engine operational performance such as output characteristic at the engine high revolution area.

As mentioned above, according to the intake system 100 of the present invention, the intake passage lengths suitable for both the engine low/intermediate revolution area and high revolution area of the V-type engine 2 are obtainable, so that the intake filling efficiency over the wide engine revolution area can be enhanced and, hence, the engine performance can be remarkably improved.

Moreover, in the intake system 100 of the present invention, the surge tank 41 and the intake passages 47 for low/intermediate revolution operation provide the protruded shape, as viewed in a plan view, towards the rear side of the V-type engine 2, so that the expansion of the surge tank 41 in the width direction of the outboard motor body can be prevented, while maintaining a relatively large volume of the surge tank 41, thus making compact the entire structure of the outboard motor 1.

Therefore, an area on the rear side of the engine cover 8 can be reduced, and hence, the dimension in the width direction of the outboard motor body is also reduced at the rear portion of the outboard motor 1. In addition, a large steering angle of the hull can be ensured and the possibility of the interference between both the two outboard motors, which are mounted to the stern of the hull, can be also prevented.

Still furthermore, in the present invention, the intake passages 47 for low/intermediate revolution operation communicating with the left-side cylinder bank of the engine 2 are arranged so as to extend on the right side of the surge tank 41, and on the other hand, the intake passages 47 for low/intermediate revolution operation communicating with the right-side cylinder bank of the engine 2 are arranged so as to extend on the left side of the surge tank 41. Further, the axial direction of the passage at the joining portion of these intake passages 47 to the intake passages 46 is made to be coincident with the passage axial direction of the manifold passage 42 of the intake manifold 40. Accordingly, it is possible to elongate the length of the intake passage 47 for low/intermediate revolution operation of the engine 2, to reduce the intake resistance by making substantially straight the shape of the passage of the portion communicating with the manifold passage 42 from the intake passage 47 and to thereby improve the engine operational performance at the low/intermediate revolution area of the V-type engine 2.

Moreover, each of the intake passages 47 for low/intermediate revolution operation once extends in both outward directions in the width direction of the outboard motor body from the surge tank 41, then turns vertically in U-shape, again extends in the inside in the width direction and is finally joined with each of the intake passages 46 for high revolution operation. Accordingly, the curved portion of the intake passages 47 for low/intermediate revolution operation has no large thickness in longitudinal direction of the outboard motor body, thus keeping compact the size of the outboard motor 1 while sufficiently maintaining the inner space of the engine cover 8 and ensuring the length of the intake passages 47, thus further improving the engine operational performance.

Furthermore, according to the intake system 100 of the present invention, the surge tank side inlets 46*a* of the respective intake passages 46 for high revolution operation of the engine 2 are arranged vertically in one line in parallel to the crankshaft 3 disposed perpendicularly in the V-type engine 2 of the outboard motor 1, the butterfly valves 62 are mounted to these surge tank side inlets 46*a*, and the single valve rotating shaft 63 for the respective butterfly valves 62 is disposed in parallel to the crankshaft 3. Accordingly, the respective butterfly valves 62 can be driven by the unified single valve rotating shaft 63. Therefore, the intake system 100 of the present invention can provide a simple structure to be manufactured easily, thus improving the maintenance performance and reducing a possibility of occurrence of defects or like, providing reliability.

Still furthermore, in the present invention, the throttle body 56 provided with the throttle valve 60 is disposed to the upper end portion of the surge tank 41 and the actuator 64 for driving the butterfly valves 62 is, on the other hand, disposed to the lower end portion of the surge tank 41. According to such arrangement, the inner space of the engine cover 8 of the outboard motor 1 can be effectively utilized and the large inner volume of the surge tank 41 can be ensured, thus improving the intake performance of the engine.

It is further to be noted that the present invention is not limited to the described embodiment and many other changes and modifications may be made without departing from the scopes of the appended claims.

What is claimed is:

1. An intake system of an outboard motor, which includes a vertically arranged V-type engine covered by an engine cover and having a crankshaft extending perpendicularly therein and right and left cylinder banks opened in V-shape towards a rear side as viewed in a plan view, and in which intake ports of respective cylinders are opened to the inside of the V-shape arrangement, said intake system comprising:

an intake manifold connected to the intake ports;

a surge tank connected to the intake manifold and disposed at a rear side from a central portion of the engine;

a throttle body mounted to the surge tank and provided with a throttle valve;

a plurality of intake passages for high revolution operation of the engine, said intake passages for high revolution operation extending from the surge tank and being communicated with the intake manifold, said plural intake passages for high revolution operation having a number corresponding to a number of the cylinders of the engine;

a plurality of intake passages for low/intermediate revolution operation of the engine, said intake passages for low/intermediate revolution operation extending from the surge tank and being joined with said intake passages for high revolution operation, respectively, said plural intake passages for low/intermediate revolution operation having a number corresponding to a number of the cylinders of the engine and each of said intake passages for low/intermediate revolution operation having a length longer than that for high revolution operation; and a valve open/close mechanism disposed for opening/closing, all at once, portions upstream side of the joined portions of the intake passages for low/intermediate revolution operation and the intake passages for high revolution operation, said intake passages for low/intermediate revolution operation extending, as viewed in a plan view, from both side surfaces of the surge tank towards both outsides in a width direction of an outboard motor body so as to be positioned at a rear portion of both the cylinder banks of the V-type engine, so that the surge tank protrudes over the intake passages for low/intermediate revolution operation towards a rear side of the V-type engine, and said intake passages for low/intermediate revolution operation having inlets on the side of the surge tank which are opened in vicinity of inlets of the intake passages for high revolution operation.

2. An intake system of an outboard motor according to claim 1, wherein said plural intake passages for low/intermediate revolution operation includes a half for left-side cylinder bank of the V-type engine to a right side of the surge tank and another half for right-side cylinder bank of the V-type engine to a left side of the surge tank so that axial directions of the intake passages for low/intermediate revolution operation at the joining portions thereof to the intake passages for high revolution operation are substantially coincident with axial directions of the passages of the intake manifold.

3. An intake system of an outboard motor according to claim 1, wherein each of said intake passages for low/ intermediate revolution operation once extends towards an outside direction from a width direction of the outboard motor body, then is turned in U-shape in a vertical direction and extends again towards an inside direction in the width direction to thereby join the intake passages for low/intermediate revolution operation of the engine to the intake passages for high revolution operation of the engine.

4. An intake system of an outboard motor according to claim 1, wherein said intake passages for high revolution operation of the engine are provided with surge tank side inlets arranged in a vertical single line in parallel to the crankshaft of the engine, said valve open/close mechanism includes a plurality of butterfly valves disposed at the surge tank side inlets, and said butterfly valves are provided with a single valve rotating shaft having an axis substantially in parallel to the crankshaft of the engine and driven thereby.

5. An intake system of an outboard motor according to claim 1, wherein said valve open/close mechanism includes a plurality of butterfly valves disposed at surge tank side inlets of the intake passages for high revolution operation, an actuator, as driving means, mounted to a lower end of a valve rotating shaft extending from the lower surface of the surge tank, and an expansion rod extending from the actuator connected to a crankshaft connected to the valve rotating shaft.

6. An intake system of an outboard motor according to claim 1, wherein said throttle valve is provided on one end of said surge tank and said valve open/close mechanism includes a drive member provided on another end of the surge tank.

7. An intake system of an outboard motor according claim 1, wherein said V-type engine is a water-cooled 6-cylinder V-type engine, three in each side of V-arrangement.

8. An intake system of an outboard motor according to claim 1, wherein said surge tank includes a lid member.

9. An intake system of an outboard motor according to claim 1, wherein said surge tank, said intake passages for high revolution operation of an engine and said intake passages for low/intermediate revolution operation of the engine are divided into front and rear halves from a division surface along an extending direction of the intake passages for low/intermediate revolution operation.

* * * * *